United States Patent [19]

List

[11] 3,973,540

[45] Aug. 10, 1976

[54] TIMING DEVICE FOR A FUEL INJECTION PUMP

[76] Inventor: Hans List, 126 Heinrichstrasse, Graz, Austria

[22] Filed: Sept. 12, 1974

[21] Appl. No.: 505,514

[30] Foreign Application Priority Data

Feb. 22, 1974 Austria ..... 1483/74

[52] U.S. Cl. ..... 123/139 AQ; 123/139 AP; 123/140 FG; 417/223; 417/319

[51] Int. Cl.[2] ..... F02M 59/20; F02D 1/12

[58] Field of Search ..... 123/139 AP, 139 AQ, 123/139 AE, 140 FG; 417/223, 506, 319

[56] References Cited

UNITED STATES PATENTS

| | | | |
|---|---|---|---|
| 1,139,898 | 5/1915 | Newcomb | 123/139 AP |
| 1,311,504 | 7/1919 | Ford | 123/139 AP |
| 2,050,392 | 8/1936 | Starr | 123/139 AP |
| 3,603,112 | 9/1971 | Sola | 123/139 AP X |
| 3,815,564 | 6/1974 | Suda et al. | 123/139 AQ |

FOREIGN PATENTS OR APPLICATIONS

| | | | |
|---|---|---|---|
| 525,665 | 9/1940 | United Kingdom | 123/140 FG |

*Primary Examiner*—Charles J. Myhre
*Assistant Examiner*—Tony Argenbright
*Attorney, Agent, or Firm*—Watson, Cole, Grindle & Watson

[57] ABSTRACT

A device for the adjustment of the injection timing of the injection pump of an automotive diesel engine, wherein the injection pump is actuated by the diesel engine via a clutch comprising two coaxially arranged clutch halves relatively rotatably by means of a vane about an angle determined by end stops.

2 Claims, 3 Drawing Figures

TIMING DEVICE FOR A FUEL INJECTION PUMP

Figure 1:
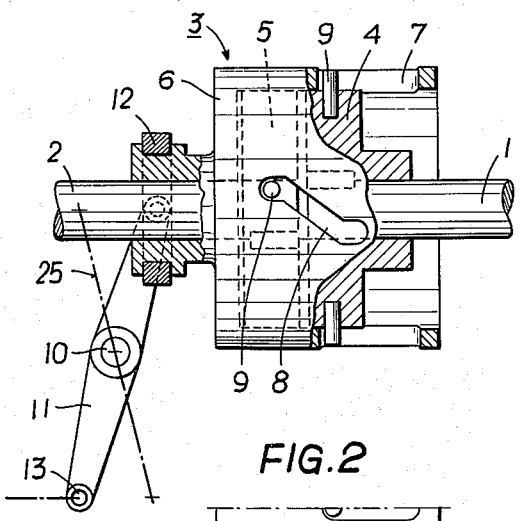

The invention relates to an automotive diesel engine comprising an injection timing device associated with the injection pump.

In a number of conventional types of diesel engines an intermediate member relatively rotatable by means of centrifugal weights is inserted in the drive of the injection pump for the purpose of timing the injection as a function of the number of revolutions. In this manner a predetermined injection timing is associated with a certain operational speed of the engine.

The basic idea of the present invention is, however, of a different nature. It is in fact, the purpose of this invention to provide an automotive diesel engine of a type ensuring a most economical operation in open spaces while providing the maximum of environmental protection for driving in densely populated areas.

On the basis of an automotive diesel engine of the type herabove described, according to the present invention the combustion system of the engine is so designed as to produce a low smoke factor and to provide an injection timing means adaptable to a first end position assuring maximum performance and minimum fuel consumption and to a second end position providing for a low percentage of noxious gases in the exhaust. The fundamental idea of this design takes advantage of the present state of technology which makes it possible to design the combustion system of a diesel engine in such a way as to keep its smoke factor on a low level while maintaining it in almost complete independence from the injection timing applicable to the prevailing operational conditions. This means, however, that while preserving the desired low smoke level it is possible to choose between two injection timings, namely one ensuring maximum performance and minimum fuel consumption at full load, and another providing for a low percentage of noxious gases, in particular of $NO_X$ and CH, in the exhaust gas.

It is therefore, sufficient for the injection timing device to comprise only two settings by means of which it will be possible to adapt the operation of the engine to the different conditions and requirements of town and country driving. Diesel vehicles, in particular trucks, are mainly used for interurban traffic and therefore, the principle of economical operation must not be impaired on overland routes, a fact which is duly taken into account by the design according to the invention. On the other hand, the invention meets to a considerable extent such requirements of environmental protection as tend to reduce the percentage of noxious gases in exhaust gases, particularly in densely populated areas and traffic congestions. The inevitable decline of the engine output as a result of this kind of operation is to be considered as unavoidable in view of world-wide efforts for the benefit of environmental protection.

According to another embodiment of the invention the device for the adjustment of the injection timer can be operated by the driver of the vehicle as required. This provides the driver with an opportunity of setting the injection timer depending on the prevailing traffic conditions, that is, not only during the transition from interurban to city traffic and vice-versa, but also in the event of traffic congestions on highways, such as for example, at front of level crossings or in the case of road accidents.

According to a further feature of the invention the device for the adjustment of the injection timer can be associated with an indicator, such as a signal lamp or an illuminated indicator board visibly mounted on the outside of the vehicle and switched on in the second setting of the adjusting device. This arrangement anticipates possible legislative measures as a result of which such automotive diesel engines as are equipped so as to ensure a low level of noxious gases in the exhaust in densely populated areas must be easily discernible by traffic control officers without having to stop the vehicle.

According to another feature of the invention however, the device for the adjustment of the injection timer can be controlled automatically as a function of the driving speed, the number of revolutions of the engine and of the amount injected by the injection pump in such a manner that when the driving speed drops below a predetermined value and the engine rotates at low speed and the quantity injected is small, the setting of the device to the second end position is delayed and so is the setting of the device to the first end position if and when a predetermined driving speed is exceeded. This automatic adjustment of the injection timer takes advantage of the fact that in view of speed-limiting regulations in city areas and of the density of traffic the driving speed is usually low and on highways the speed is reduced uphill only, in which cases the engine rotates with a greater number of revolutions and the vehicle is thrown in low gear.

It is the purpose of delaying the switchover as hereabove described to avoid shifting from urban-area operation with a low-level production of noxious gases during the starting and temporary accelerations to the interurban operational method as well as during starting and at driving speeds within the admissible speed limits in urban areas if the engine is operated with a low number of revolutions and small loads.

On highways, the driving speed is generally high and low speeds usually prevail for uphill travel only, where engine loads are, however, of a high level (high number of revolutions, large quantities injected). As a result of the delay provided also for the switchover from the second to the first end position, this shift at low speed and a high engine load is allowed to occur only after a certain lapse of time as required also for accelerations within urban areas.

Accordingly, the adjusting device will be switched over into the first end position during high-speed interurban travelling, for driving within urban areas only when the admissible speed limit is exceeded and if a higher engine speed is combined with increased engine loads and consequently, the adjusting rod of the injection pump has been set to a larger amount to be injected and if this condition prevails for a longer period of time than usually required for normal starting within urban areas. Only when traveling uphill within urban areas for a considerable length of time will the driver have to switch off the automatics and to set the adjusting device manually to the second end position for a low percentage of noxious gases in the exhaust.

The adjusting device is, however, shifted from the first to the second end position with a delay provided for the purpose of avoiding switchovers during brief vehicle braking operations, if and when the speed of the motor vehicle drops below the level admissible for urban-area traffic and a low engine speed and a small-quantity injection prevail at the same time.

In actual practice, the invention can be carried out with a great variety of design features. According to a particularly simple embodiment of the invention, the device for the adjustment of the injection timer is designed as a clutch assembly comprising two clutch halves, one of which is non-rotatably connected to the camshaft of the injection pump and the other to the pump-driving shaft actuated by the engine, the said clutch halves being relatively rotatable by means of a vane about an angle determined by means of limit stops. This arrangement distinguishes itself by its compactness and by its dependable operation and plain design.

According to another feature of the invention the vane is designed as an axially slidable socket encompassing the clutch halves and having guide slots on its circumference in which carrier bolts radially protruding from the clutch halves engage, the said guide slots for at least one of the clutch halves forming acute angles with the peripheral direction of the socket or extending along a helical line. For the adjustment of the socket such means as are generally employed in the construction of speed-regulating devices, such as, for example, a forked lever engaging an annular groove of the socket, can be used. According to another embodiment of the invention to be used in connection with the automatic switchover of the adjusting device, the vane is drivingly connected with a double-acting hydraulic working cylinder whose cylinder changers located on both sides of the piston each are connectable via a solenoid valve with the pressure-oil pipe of the engine and on the other hand, each is connectable via a further solenoid valve with a return line leading to the oil sump of the engine. The total of four solenoid valves are controlled as a function of the driving speed, the number of revolutions of the engine and the quantity to which the injection pump has been set, for example, by means of an electronic auxiliary device covering these values. Each of the solenoid valves inserted in the pressure-oil line is connected in parallel with the diagonally opposite solenoid valve controlling the discharge into the oil sump.

Figure 2:
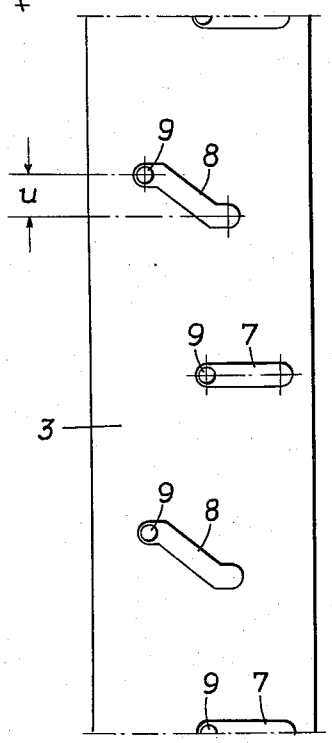
Figure 3:
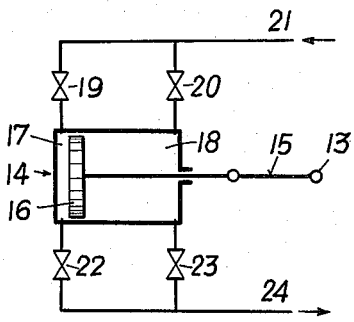

Further details of the invention will become apparent from the following description of an embodiment of the invention by way of example, with reference to the accompanying drawing in which FIG. 1 shows an axial cross-sectional view of a device for the adjustment of the injection timing in an automotive diesel engine according to the invention, FIG. 2 a developed projection of an essential detail of the device shown in FIG. 1, and FIG. 3 is a schematic sectional view of an automatic operating gear for a device according to FIG. 1.

In FIG. 1 the camshaft of the injection pump (not shown) of an automotive diesel engine is designated by reference numeral 1. The driving shaft for the injection pump arranged in coaxial relation thereto and actuated by the engine via an intermediate gear (not shown in the drawing) is designated by reference numeral 2. The shafts 1 and 2 are drivingly interconnected by means of a clutch 3.

The clutch 3 comprises two disk-shaped clutch halves 4 and 5 of which the one designated by reference numeral 4 is keyed on to the camshaft 1 and the other clutch half 5 is keyed to the driving shaft 2. Axially displaceable on the driving shaft 2 is a socket 6 encompassing the two clutch halves 4 and 5 and having guide slots 7 and 8 on its periphery which engage carrier bolts 9 radially protruding from the clutch halves 4, 5.

As appears from the development of the circumference of the socket 6 in FIG. 2, the guide slots 7 cooperating with the bolts 9 of the clutch half 4 extend in parallel relation to the common axis of the two shafts 1 and 2, whereas the guide slots 8 for the clutch half 5 located in between form an acute angle with the peripheral direction of the socket 6. In the right end position of the socket 6 shown in the drawing the carrier bolts 9 adjoin the left end of the guide slots 7 and 8, respectively. When the socket 6 is displaced axially to the left, the carrier bolts 9 in the guide slots 7 and 8 respectively, slide as far as their right end position. The carrier bolts 9 associated with the clutch half 5 are offset in a circumferential direction by the distance $u$ producing a relative rotation of the clutch halves 4 and 5 about an angle corresponding to the distance $u$. As a result of this relative rotation the injection timing of the injection pump is altered. By the appropriate selection of the angle of the guide slots 8 in relation to the circumferential direction, two end positions of the clutch are determined, one of which corresponds to the most convenient timing ensuring maximum performance and minimum fuel consumption at full load, and the other to the timing ensuring a low percentage of noxious gas $NO_X$ and CH in the exhaust gas. Therefore, the first-mentioned end position is destined for interurban traffic and the other end position is intended for driving in crowded areas, especially for driving in towns and cities. By means of an appropriate layout of the combustion system of the engine it is possible to keep the smoke factor at a low level and to make it almost independent from the injection timing so that the smoke factor can be maintained on the desired low level in both end positions of the socket 6.

For initiating the socket motion a two-arm lever 11 pivoted about the axis 10 is provided, one arm of which is fork-shaped in a manner known per se and articulated on a ring 12 engaging in an annular groove of the socket 6. At the other extremity of the lever 13 either a lever system (not shown in the drawing) or the like, extending as far as the driver's cabin engages, so that it can be actuated by the driver, or else an hydraulic arrangement is provided, the vane of which is drivingly connected with the extremity of the lever 13.

The schematic drawing of FIG. 3 illustrates such a servo arrangement. It comprises a double-acting hydraulic working cylinder 14 whose piston rod 15 is hinged to the extremity of the lever 13 (FIG. 3). The piston of this working cylinder 14 is designated by reference numeral 16. The working chambers 17 and 18 respectively, of the working cylinder 14, located on both sides of the piston 16, are connected to the pressure-oil pipe 21 of the associated engine via a solenoid valve each, designated by reference numerals 19 and 20, respectively. Besides, the working chambers 17 and 18 are each connected via a solenoid valve 22 and 23 respectively, with the oil-return pipe 24 leading to the oil sump of the engine (not shown in the drawing).

In order to move the socket 6 of the clutch 3 into the right end position shown in FIG. 1 of the drawing, the working chamber 18 of the cylinder 14 is impinged upon with pressure oil via the solenoid valve 20, the oil being simultaneously evacuated from the working chamber 17 into the oil-return pipe through the open solenoid valve 22, the solenoid valves 19 and 23 remaining closed.

For shifting the clutch 3 into its other end position in which the lever 11 occupies the position 25 shown by a dash-and-dot line in the drawing, the socket 6 being displaced to the left side, the solenoid valves 19 and 23 are simultaneously opened while the valves 20 and 22 are closed, the pressure-oil entering the working chamber 17 displacing the piston 16 towards the right side and the oil being discharged from the working chamber 18 into the oil-return pipe 24.

As hereabove explained, the solenoid valves 19, 20, 22 and 23 are controlled as a function of the driving speed, the number of revolutions of the engine and the amount to be injected according to the setting of the injection pump. As soon as the driving speed drops below a certain predetermined level, accompanied by a low number of revolutions of the engine and a small amount injected, the device is switched over from normal overland driving to city operation producing a low percentage of noxious gases upon expiration of an equally predetermined delay by actuating the appropriate solenoid valves. The device is then again reset to the end position for ordinary overland driving if and when the predetermined driving speed has been exceeded upon the expiration of a corresponding delay.

In addition to the embodiment of the invention hereabove described there is a great number of further possibilities of carrying the inventive idea into effect. For example, the socket provided with guide slots can be replaced by a socket having a bevel gear on its inside engaged by the clutch halves with a corresponding external toothing. Furthermore, the relative rotation between the camshaft 1 and the driving shaft 2 can also be effected by means of a bevel gearing designed like a differential whose intermediate gear wheel is mounted on a shaft which is orientable with relation to the camshaft axis between stops.

I claim:

1. A device for the timing of the injection of an injection pump of an automotive diesel engine from a first end position for high engine performance and a minimum fuel consumption at full load into a second end position for a low percentage of noxious gases in the exhaust gas, comprising a pump-driving shaft, a pump camshaft in coaxial relation to same, a clutch consisting of two clutch halves one of which is non-rotatably connected with the pump camshaft and the other with the pump-driving shaft, and means for causing relative rotation of the two clutch halves about a predetermined angle from one end position to the other end position, said device further comprising a forced-lubrication system, a double-action hydraulic working cylinder, a piston slidable in said working cylinder and dividing same into two cylinder chambers, said piston being drivingly connected with said means, one supply line controlled by means of a solenoid valve emerging from each of the cylinder chambers and connected with the forced-lubrication system, and one return line controlled by means of a solenoid valve emerging from each of the cylinder chambers.

2. A device according to claim 1, said means comprising axially slidable socket encompassing the two clutch halves, a number of guide slots arranged on the periphery of said socket, a number of carrier bolts radially protruding from the periphery of each of the two clutch halves and engaging the guide slots of the socket, at least the guide slots for the carrier bolts of one clutch half forming acute angles with the peripheral direction of the socket.

* * * * *